US012274407B1

(12) United States Patent
Messineo et al.

(10) Patent No.: US 12,274,407 B1
(45) Date of Patent: Apr. 15, 2025

(54) FRAME SYSTEM AND CLEANING DEVICE FRAME

(71) Applicant: Carl Freudenberg KG, Weinheim (DE)

(72) Inventors: Carlo Messineo, Milan (IT); Felix Fallenstein, Speyer (DE); Nikolai Sand, Speyer (DE); Maik Bieganski, Weinheim (DE); Ralf Juergens, Laudenbach (DE)

(73) Assignee: CARL FREUDENBERG KG, Weinheim (DE)

( * ) Notice: Subject to any disclaimer, the term of this patent is extended or adjusted under 35 U.S.C. 154(b) by 0 days.

(21) Appl. No.: 18/835,741

(22) PCT Filed: Feb. 2, 2023

(86) PCT No.: PCT/EP2023/052583
§ 371 (c)(1),
(2) Date: Aug. 5, 2024

(87) PCT Pub. No.: WO2023/148279
PCT Pub. Date: Aug. 10, 2023

(30) Foreign Application Priority Data

Feb. 7, 2022 (DE) ..... 10 2022 102 738.4

(51) Int. Cl.
*A47L 13/258* (2006.01)
*A47L 13/42* (2006.01)

(52) U.S. Cl.
CPC ..... *A47L 13/258* (2013.01); *A47L 13/42* (2013.01)

(58) Field of Classification Search
CPC ..... A47L 13/258; A47L 13/254; A47L 13/42
See application file for complete search history.

(56) References Cited

U.S. PATENT DOCUMENTS 4,731,897 A * 3/1988 Griffin ..... A47L 13/254 15/228
4,766,632 A * 8/1988 Murray ..... A47L 13/258 15/228

(Continued)

FOREIGN PATENT DOCUMENTS

DE 3808310 A1 9/1989
DE 20114744 U1 11/2001

(Continued)

*Primary Examiner* — Shay Karls
(74) *Attorney, Agent, or Firm* — Leydig, Voit & Mayer, Ltd.

(57) ABSTRACT

A frame system for a modular construction of flat mop cleaning device frames including a first carrier plate having a first length in a longitudinal direction and a first width in a transverse direction, and a second carrier plate having a second length in the longitudinal direction different from the first length and a second width in the transverse direction corresponding to the first width. The frame system includes a third carrier plate having a third length in the longitudinal direction different from the first and second length, and a third width in the transverse direction corresponding to the first and second width. The frame system further includes a first clamp forming longitudinal delimitations of the first, second and third carrier plates and a second clamp forming longitudinal delimitations of the third carrier plate. The second clamp has a greater length than the first clamp.

7 Claims, 2 Drawing Sheets

(56) References Cited

U.S. PATENT DOCUMENTS

| | | | | |
|---|---|---|---|---|
| 7,607,191 | B2 * | 10/2009 | Morris | A47L 13/258 15/228 |
| 9,918,607 | B1 * | 3/2018 | Lewis | A47L 13/253 |
| 2005/0091775 | A1 * | 5/2005 | Lindholm | A47L 13/258 15/228 |

FOREIGN PATENT DOCUMENTS

| | | | |
|---|---|---|---|
| EP | 0599227 | A1 | 6/1994 |
| EP | 1527728 | A2 | 5/2005 |
| JP | H08215124 | A | 8/1996 |
| SE | 390792 | B | 1/1977 |

* cited by examiner

FRAME SYSTEM AND CLEANING DEVICE FRAME

CROSS REFERENCE TO RELATED APPLICATIONS

This application is a U.S. National Phase application under 35 U.S.C. § 371 of International Application No. PCT/EP2023/052583, filed on Feb. 2, 2023, and claims benefit to German Patent Application No. DE 10 2022 102 738.4, filed on Feb. 7, 2022. The International Application was published in German on Aug. 10, 2023 as WO 2023/148279 A1 under PCT Article 21(2).

FIELD

The invention relates to a frame system for a modular construction of cleaning device frames and a cleaning device frame.

BACKGROUND

Cleaning device frames are generally known.

The previously known frames fit a mop of corresponding form with which they are covered during correct use.

In this instance, the frame and the fitting mop form a technical functional unit, wherein the frame is always used in one production-related form thereof together with the mop. Structural changes to the frame, so that it can be used with mops which differ from each other in terms of form, are not possible and not provided for.

Mops which differ from each other in terms of their size are combined with frames which are in each case configured and produced separately.

SUMMARY

In an embodiment, the present disclosure provides a frame system for a modular construction of four different flat mop cleaning device frames comprising a first carrier plate having a first length in a longitudinal direction and a first width in a transverse direction and a second carrier plate having a second length in the longitudinal direction which is different from the first length and a second width in the transverse direction which corresponds to the first width. The frame system further comprises a third carrier plate having a third length in the longitudinal direction which differs from the first length and the second length and a third width in the transverse direction which corresponds to the first width and the second width. The frame system further comprises a first clamp. The first clamp forms longitudinal delimitations of the first, second and third carrier plates and a second clamp forms longitudinal delimitations of the third carrier plate. The second clamp has a greater length than the first clamp.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
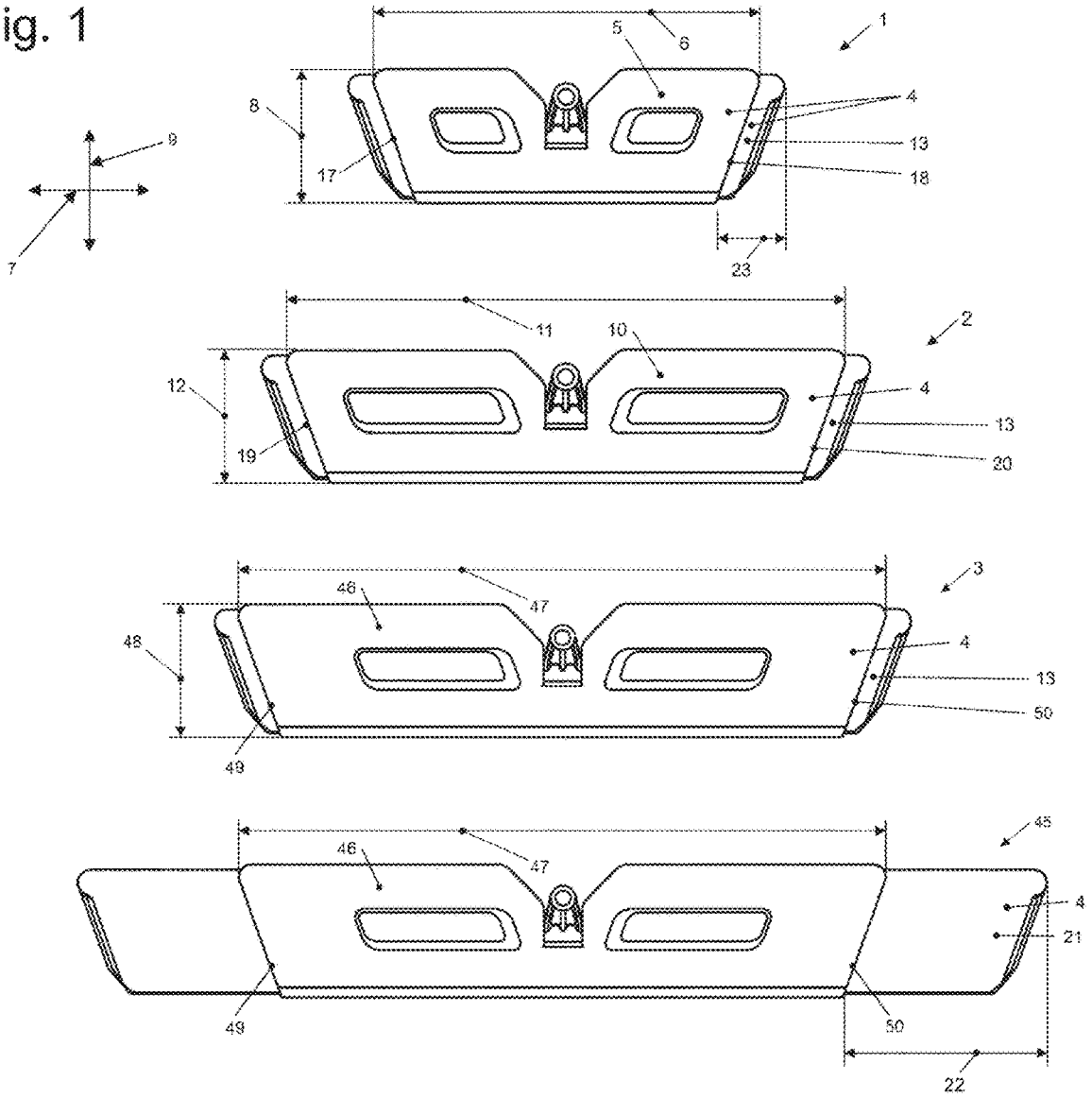
FIG. 1 shows a frame system for a modular construction of four different cleaning device frames.

In an embodiment, the present invention adapts cleaning device frames of a frame system in the simplest manner possible to flat mops which differ from each other in terms of their shape. Different frames should have as many identical components as possible and have a simple structure with few components and in technical production terms and from an economic viewpoint thereby be able to be produced in a simple and cost-effective manner.

Furthermore, the frames as a result of their simple structure with few components should be simple for the user to handle. Assembly errors should, as a result of the geometry of the frames, be practically excluded.

In order to achieve the foregoing, a frame system for a modular construction of four different flat mop cleaning device frames is provided, comprising only five components, that is to say, a first carrier plate having a first length in the longitudinal direction and a first width in the transverse direction and a second carrier plate having a second length in the longitudinal direction which is different from the first length and a second width in the transverse direction which corresponds to the first width and a third carrier plate having a third length in the longitudinal direction which differs from the first length and the second length and a third width in the transverse direction which corresponds to the first width and the second width and a first clamping element, wherein the first clamping element forms longitudinal delimitations of the first, second and third carrier plates and a second clamping element which forms longitudinal delimitations of the third carrier plate, wherein the second clamping element has a greater length than the first clamping element.

The term "length" of the clamping elements in the context of the present disclosure is used to refer to the length of the clamping elements with which the clamping elements protrude in the longitudinal direction over the carrier plates to which they are connected.

The first length of the first carrier plate is in this instance preferably smaller than the second length of the second carrier plate, and the second length of the second carrier plate is smaller than the third length of the third carrier plate.

As a result of the modular frame system, it is possible, as a result of identical components with few parts, to produce differently configured frames for different flat mops in a simple and cost-effective manner. In this instance, with only five components, four frames which differ from each other in terms of their shape, in particular the length thereof, can be produced.

The five components, which the four different flat mop cleaning device frames comprise, are three different carrier plates and the first and second clamping elements.

With a first frame, for example, a short first carrier plate is combined with short first clamping elements. The clamping elements which are used are in each case in the form of identical components.

With a second frame, a relatively longer second carrier plate is combined with the same first clamping elements. Also in this instance, the clamping elements which are used are in each case in the form of identical components.

With a third frame, a third carrier plate which is even longer compared with the first and second carrier plates is combined with the first clamping elements. The clamping elements are again in each case in the form of identical components. With a fourth frame, the third carrier plate of the third frame will be combined with second clamping elements which are longer compared with the first clamping elements.

The second clamping elements are also in the form of identical components.

The above-mentioned clamping elements are, as already set out above, in each case in the form of identical components and can, when viewed in the longitudinal direction of the carrier plates, be secured both on the left and right at the transverse sides of the carrier plates, in a resilient manner in the longitudinal direction. A mop can thereby be simply pulled onto the frame.

The second clamping element can have a length in the longitudinal direction which substantially corresponds to a quarter of the third length of the third carrier plate in the same direction. The fourth frame thereby has on the whole a significantly greater length than the third frame without becoming unmanageable for the user.

The clamping elements are configured without wipers for wiping a mop from the frame. In this instance, it is advantageous for there to be no components which protrude from the clamping element and which during correct use of the cleaning device could, for example, remain caught on projections or pieces of furniture, An embodiment of the invention further relates to a cleaning device frame of a frame system as described above for a mop of a flat mop cleaning device, comprising a carrier plate having two longitudinal sides which are arranged in the longitudinal direction and two transverse sides which are arranged in the transverse direction and two clamping elements for clamping the mop on the carrier plate, wherein each clamping element is resiliently connected to one of the transverse sides in the longitudinal direction, wherein the carrier plate is intersected in the longitudinal direction centrally by a notional plane of symmetry, wherein the carrier plate is formed symmetrically relative to the plane of symmetry and wherein the clamping elements are in the form of identical components and are arranged symmetrically relative to the plane of symmetry.

Such a frame is with respect to its technical features completely symmetrical, with respect to the plane of symmetry. The handling of the frame is thereby simplified for the user since a fitting flat mop can be pulled practically freely and thereby in a simple manner onto the frame.

Generally, the mop must surround the frame in a tight manner in order to prevent a relative movement between the mop and frame during correct use of the cleaning device where possible. A mop which is pulled tightly onto the frame can generally be pulled less well onto the frame and removed from the frame where necessary. The pulling/removal of the mop onto/from the frame is possible as a result of the clamping elements which are resilient in the longitudinal direction. In order to pull on/remove the mop, they, in the longitudinal direction of the carrier plate, can be compressed in a resiliently flexible manner in order to thus enable the pulling/removal of the mop onto/from the frame. The resilient clamping elements hold the mop during the correct use of the cleaning device under tension tightly on the frame.

As a result of the clamping elements which are connected in a resiliently flexible manner in the longitudinal direction to the carrier plates, mops of which the length differs from a standard dimension, can be readily pulled onto the carrier plates.

Furthermore, the carrier plate can have two substantially hand-wide apertures which are arranged symmetrically relative to the plane of symmetry. The apertures extend parallel with the longitudinal axis of the carrier plate. The apertures preferably have a length which is at least 70 mm. As a result of the apertures, it is possible for the frame when pulling on a new mop to be able to be held in one hand in an ergonomically advantageous manner.

In the plane of symmetry and symmetrically relative thereto and when viewed in the transverse direction, substantially centrally in the carrier plate a receiving member which can be pivoted about a pivot axis which extends parallel with the longitudinal direction can be arranged for securing a handle. The receiving member is arranged substantially at the center of gravity of the carrier plate.

With such a configuration, it is advantageous for a pocket-like mop which is clamped on the frame to be able to be used at both sides. The frame with the clamped mop is to this end simply pivoted about the pivot axis.

FIG. 1 shows a frame system for a modular construction of four different cleaning device frames 1, 2, 3, 45.

All four frames 1, 2, 3, 45 can be produced from a total of only five components 4.

The five components 4 which the four different mop cleaning device frames 1, 2, 3, 45 comprise are the three different carrier plates 5, 10, 46, the first clamping element 13 and the second clamping element 21.

In the kit of the cleaning system for the modular construction, the first carrier plate 5 is located with the first length 6 in the longitudinal direction 7 and the first width 8 in the transverse direction 9. Furthermore, the second carrier plate 10 is located with the second length 11 in the longitudinal direction 7 and the second width 12 in the transverse direction 9. The second length 11 is greater than the first length 6, the first width 8 and second width 12 are identical in comparison.

Furthermore, the kit of the cleaning system comprises the third carrier plate 46 with the third length 47 in the longitudinal direction 7 and the third width 48 in the transverse direction 9. The first width 8, the second width 12 and the third width 48 are identical. The first length 6 is smaller than the second length 11, the second length 11 is smaller than the third length 47.

In order to be able to pull pocket-like flat mops onto the frames 1, 2, 3, 45 in the simplest manner possible, the first and second clamping elements 13, 21 are provided. The first clamping element 13 is secured to the first carrier plate 5 of the first frame 1, the second carrier plate 10 of the second frame 2 and the third carrier plate 46 of the third frame 3.

In order to pull the respective mops onto the frames 1, 2, 3, 45, the clamping elements 13, 21 are connected in the longitudinal direction 7 in a resilient manner to the respective longitudinal limitations 17, 18; 19, 20; 49, 50 of the carrier plates 5, 10, 46.

The clamping elements 13, 21 which are used on each frame 1, 2, 3, 45 are in each case in the form of identical components.

With a minimum number of components 4, five in the exemplary embodiment shown, it is possible by means of skillful combination of the components 4 to produce four frames 1, 2, 3, 45 which are different from each other for corresponding flat mops.

The frames 1, 2, 3, 45 are each configured completely symmetrically with respect to the notional plane of symmetry 34, as will be explained in greater detail below with reference to FIG. 2.

Figure 2:
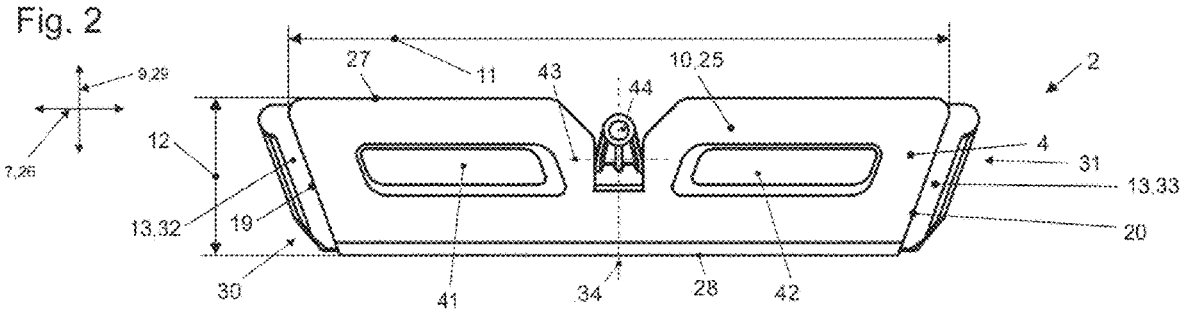
FIG. 2 shows a frame of the frame system from FIG. 1.

In FIG. 2, the second frame 2 from FIG. 1 is shown as an individual component.

The frame 2 comprises the carrier plate 25, which has two longitudinal sides 27, 28 arranged in the longitudinal direction 26 and two transverse sides 30, 31 which are arranged in the transverse direction 29. Furthermore, the frame 2 comprises two clamping elements 32, 33 for clamping a mop on the carrier plate 25. Each of the clamping elements 32, 33 which are configured in an identical manner is connected in the longitudinal direction 26 in a resilient manner to one of the transverse sides 30, 31. Centrally in the longitudinal direction 26, the carrier plate 25 is intersected by the notional plane of symmetry 34, wherein the carrier plate 25 is configured symmetrically with respect to the plane of symmetry 34.

The symmetry relates to all functionally relevant components 4. This applies to the carrier plate 25 itself, the two clamping elements 32, 33 and also to the two substantially hand-wide apertures 41, 42 which are located in the carrier plate 25 and which extend substantially parallel with the longitudinal direction 26.

In order to secure the frame 2 to a handle, the pivotable receiving member 44 which can be pivoted about the pivot axis 43 which extends parallel with the longitudinal direction 26 of the carrier plate 25 is provided. With respect to the plane of symmetry 34, the receiving member 44 is also configured and arranged symmetrically.

While subject matter of the present disclosure has been illustrated and described in detail in the drawings and foregoing description, such illustration and description are to be considered illustrative or exemplary and not restrictive. Any statement made herein characterizing the invention is also to be considered illustrative or exemplary and not restrictive as the invention is defined by the claims. It will be understood that changes and modifications may be made, by those of ordinary skill in the art, within the scope of the following claims, which may include any combination of features from different embodiments described above.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A frame system for a modular construction of four different flat mop cleaning device frames comprising:

a first carrier plate having a first length in a longitudinal direction and a first width in a transverse direction;

a second carrier plate having a second length in the longitudinal direction which is different from the first length and a second width in the transverse direction which corresponds to the first width;

a third carrier plate having a third length in the longitudinal direction which differs from the first length and the second length and a third width in the transverse direction which corresponds to the first width and the second width;

a first clamp, wherein the first clamp forms longitudinal delimitations of the first, second and third carrier plates; and a second clamp which forms longitudinal delimitations of the third carrier plate, wherein the second clamp has a greater length than the first clamp.

2. The frame system as claimed in claim 1, wherein the first length is smaller than the second length and the second length is smaller than the third length.

3. The frame system as claimed in claim 1, wherein the second clamp has a length in the longitudinal direction which substantially corresponds to a quarter of the third length in the same direction.

4. A cleaning device frame of the frame system as claimed in claim 1, comprising:

a carrier plate having two longitudinal sides which are arranged in the longitudinal direction and two transverse sides which are arranged in the transverse direction and two clamps for clamping the mop on the carrier plate, wherein each clamp is resiliently connected to one of the transverse sides in the longitudinal direction, wherein the carrier plate is intersected in the longitudinal direction centrally by a notional plane of symmetry, wherein the carrier plate is formed symmetrically relative to the plane of symmetry and wherein the clamps are in the form of identical components and are arranged symmetrically relative to the plane of symmetry.

5. The frame as claimed in claim 4, wherein the carrier plate has two substantially hand-wide apertures which are arranged symmetrically relative to the plane of symmetry.

6. The frame as claimed in claim 5, wherein in the plane of symmetry and symmetrically relative thereto and when viewed in the transverse direction, substantially centrally in the carrier plate a receiving member which can be pivoted about a pivot axis which extends parallel with the longitudinal direction is arranged for securing a handle.

7. The frame as claimed in claim 4, wherein in the plane of symmetry and symmetrically relative thereto and when viewed in the transverse direction, substantially centrally in the carrier plate a receiving member which can be pivoted about a pivot axis which extends parallel with the longitudinal direction is arranged for securing a handle.

* * * * *